United States Patent [19]

Liu

[11] Patent Number: 4,473,379

[45] Date of Patent: Sep. 25, 1984

[54] PROCESS FOR MAINTAINING HEAT PROTECTIVE LAYERS OF SOLIDIFIED SYNTHETIC SLAG WITHIN A SLAGGING COAL GASIFIER

[75] Inventor: Chih-Hsiung F. Liu, Houston, Tex.

[73] Assignee: Shell Oil Company, Houston, Tex.

[21] Appl. No.: 479,228

[22] Filed: Mar. 28, 1983

[51] Int. Cl.[3] ..... C10J 3/00; C10J 3/46

[52] U.S. Cl. ..... 48/210; 48/DIG. 2; 110/343; 110/347

[58] Field of Search ..... 48/202, 210, DIG. 2, 48/DIG. 7; 110/229, 343, 342, 347, 263, 264

[56] References Cited

U.S. PATENT DOCUMENTS

| | | | |
|---|---|---|---|
| 2,866,697 | 12/1958 | Elliot | 48/DIG. 2 |
| 4,351,647 | 9/1982 | Marion et al. | 48/DIG. 7 |
| 4,401,440 | 8/1983 | Alink | 48/210 |
| 4,408,548 | 11/1983 | Schmalfeld | 110/347 |

*Primary Examiner*—S. Leon Bashore
*Assistant Examiner*—K. M. Hastings

[57] ABSTRACT

The performance of a slagging coal gasifier is improved by injecting finely divided particles of noncorrosive slag-like solid material into the gasifier near the zone of combustion at a rate at which heat-protective layers of solidified slag are maintained between that zone and metallic materials located near that zone.

5 Claims, 1 Drawing Figure

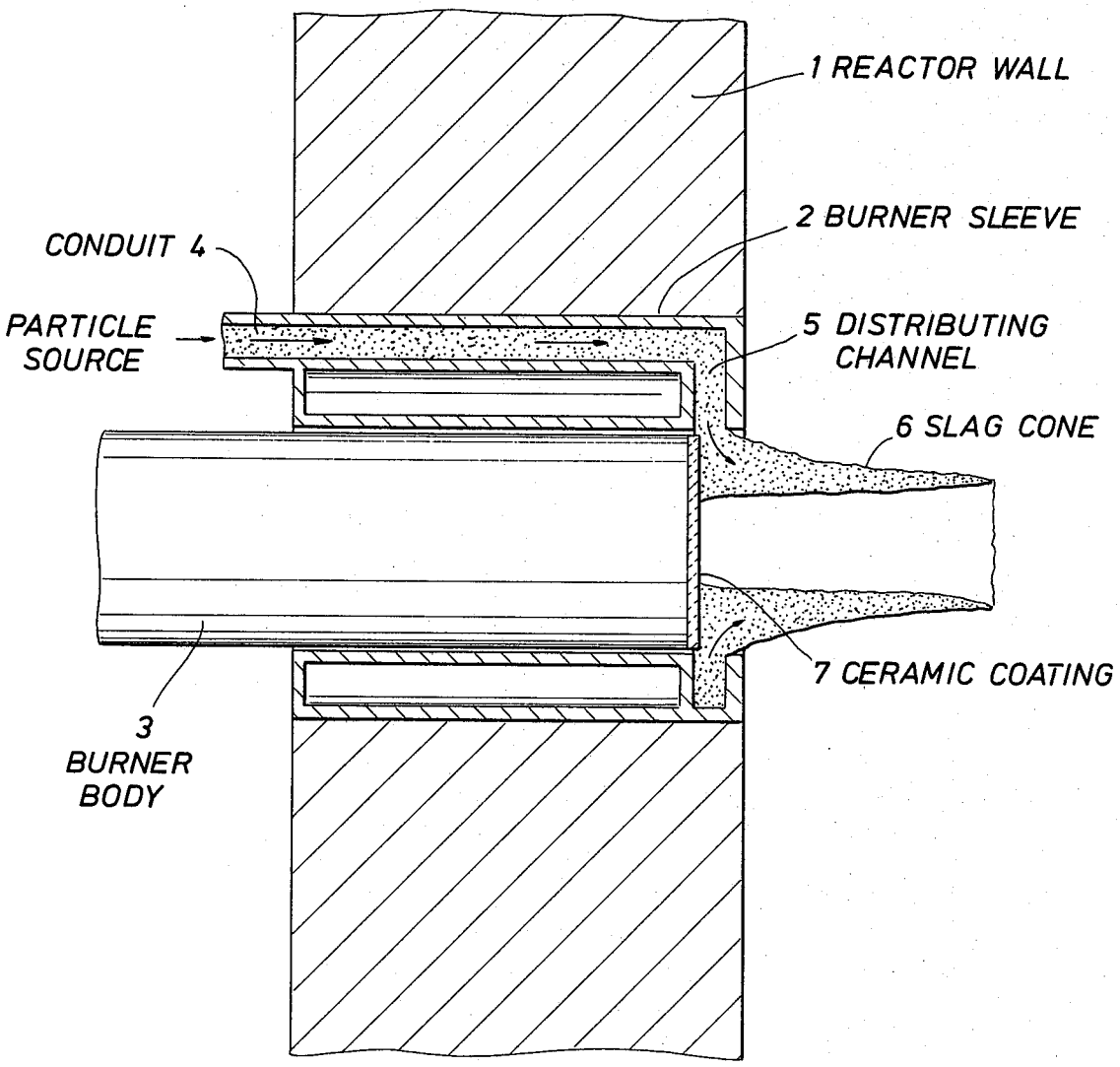
1 REACTOR WALL
2 BURNER SLEEVE
CONDUIT 4
PARTICLE SOURCE
5 DISTRIBUTING CHANNEL
6 SLAG CONE
7 CERAMIC COATING
3 BURNER BODY

PROCESS FOR MAINTAINING HEAT PROTECTIVE LAYERS OF SOLIDIFIED SYNTHETIC SLAG WITHIN A SLAGGING COAL GASIFIER

BACKGROUND OF THE INVENTION

This invention relates to a process for converting coal to gaseous products in a slagging type of coal gasifier or reactor. More particularly, the process relates to ensuring the forming and maintaining of heat insulating layers of solidified slag in locations between the combustion zone within the gasifier and metallic materials which are located near that zone.

Coal is commonly subjected to partial combustion, to produce gases which are useful as fuels and starting materials for chemical syntheses and the like, in a slagging gasifier. The combustion temperatures are usually kept at about 1500° to 2700° C. to convert the coal ash into a molten slag. The slagging coal gasifiers are generally the most flexible in terms of the variety of coal feedstocks which can be efficiently utilized. A significant proportion of the molten slag is continuously or intermittently removed from the bottom of the gasifier. Where desirable, additional portions of molten slag are produced by condensing the fly ash in the gaseous products and are flowed down within the walls of the reactor, for example, as described in U.S. Pat. No. 4,054,424.

In slagging coal gasifiers pulverized coal is introduced by means of one or more burners through which streams of pulverized coal, carrier gas and oxygen are injected into the combustion zone of the reactor. In general, it is necessary that some metallic materials, at least along the inner (or front) faces of such burners, be located near the combustion zone of the reactor. The inner walls of the reactor are usually composed of or lined with a refractory material such as a firebrick or other ceramic material. The faces of the burners are formed of heat resistant metals having high melting points and the burners are commonly provided with a water cooling system. The combustion zone is subjected to both the high temperatures and turbulent motion of the burning gases and liquefied and solidifying solid particles of coal, fly ash and molten slag. This provides a highly corrosive atmosphere adjacent to any nearby metallic surfaces and tends to corrode them at an undesirably high rate.

SUMMARY OF THE INVENTION

The present invention relates to a process for forming and maintaining a noncorrosive layer of solidified slag over metallic materials located at the face of a burner near the zone of combustion within a slagging coal gasifier. A stream of finely divided particles of heat protective solid synthetic slag material having a noncorrosive composition on which the coal-formed slag tends to accrete, is injected into the gasifier in at least one location which is near the face of at least one burner and is separate from any conduit through which coal and combustion supporting gas are introduced into the gasifier. The synthetic slag material is introduced at a rate and to an extent sufficient to form and maintain a base layer of solid synthetic slag material between the metallic materials and the combustion zone without causing that layer or the layer of coal-formed slag which adheres to it to thicken to an extent at which it impedes the outflow of molten slag from the gasifier.

BRIEF DESCRIPTION OF THE DRAWING

The drawing is a schematic illustration, partly in cross section, of a portion of a slagging coal gasifier in which the present invention is being employed.

DESCRIPTION OF THE INVENTION

As shown in the drawing, the present invention is particularly useful in respect to forming a heat protective layer on the face of a burner through which the coal and oxygen is injected. Solidified slag tends to form on a burner face in a shape generally like a hollow cone and is commonly referred to as a slag cone. In a suitable embodiment of the invention, the reactor wall 1 of a slagging coal gasifier is penetrated by at least one burner sleeve 2 for supporting a burner body 3. In accordance with the present invention the burner sleeve is arranged to contain at least a portion of a conduit 4 which communicates with a particle source (not shown) through which a stream of finely divided heat resistant solid synthetic slag particles can be displaced into the burner sleeve. Within the burner sleeve, the stream of synthetic slag particles is conducted into a ring-shaped distributing channel 5 from which the particles flow in a generally radially inward direction onto the face of the burner body where they form a protective base on which coal-formed slag will deposit.

In general, in using the present invention the slagging gasifier can be constructed and operated in a substantially conventional way with the exception of an arrangement for injecting at least one stream of finely divided heat protective synthetic slag particles capable of forming a "friendly" slag of noncorrosive nature, and thus forming the base of a protective layer of synthetic and coal-formed solidified slag. Layers of gradually downflowing portions of molten coal-formed slag and portions of fly ash deposit or accrete on this base rather than attaching to and/or eroding exposed metal surfaces such as the burner face material. The particles of such a synthetic slag material are pushed into the reactive zone of the gasifier at a relatively slow rate at which they tend to build up a slag cone of accreted coat-formed slag such as slag cone 6 on the face of the burner around the orifice through which the coal and oxygen are injected.

In a preferred embodiment, the exposed face of burner body 3 is precoated with a ceramic material to enhance the adherence of such a slag cone.

The particles of synthetic slag material can be pushed through the conduit 4 and distributing channel 5 by means of conventional particle extruding devices such as an auger or solids pump. The rate at which the particles are pushed out into the gasifier should be an extremely slow rate controlled to replenish the exposed and eroded-off portions of the synthetic slag base for the slag cone without causing the heat protective layers and/or cones of solidified slag to thicken to an extent impeding the outflow of molten slag from the gasifier.

In general, the burners used in conjunction with the present invention can be substantially any which are suitable for the injection of a combustible mixture of pulverized coal and oxygen into the gasifier. The coal can be substantially any finely divided type of hard or soft coal, lignite, or the like, capable of providing partial combustion products which are useful gaseous products and slag, in a manner similar to that of pulverized coal.

In a preferred embodiment the slagging gasifier employed in the practice of the present invention contains a plurality of burners of the type described in U.S. Pat. No. 4,193,773. The forming and maintaining of the protective layers of solid slag are preferably enhanced by condensing downflowing portions of molten slag particles from the fly ash in the outflowing partial combustion products of the gasification reaction in the manner described in U.S. Pat. No. 4,054,424.

In general, the finely divided solid particles of synthetic slag used in the present invention can be substantially any such particles which are heat protective heat-resistive, noncorrosive and have surfaces on which hot fly ash particles and molten slag tend to adhere and accrete. Examples of suitable particles include powdered silica, mixtures of silicious solids with calcium or calcium salts, cooled ash particles, such as those which are separated by cyclones from the gaseous gasifier products and which have become substantially free of corrosively reacting components. Powdered silica or silica mixed with noncorrosive calcium salts are particularly suitable materials.

What is claimed is:

1. A process for forming and maintaining heat protective layers of solid slag between metallic materials and the zone of combustion within a slagging coal gasifier in which a combustible mixture of coal and oxygen is injected through at least one burner comprising:

injecting into the gasifier, in at least one location which is near the inner face of at least one of said burners but is separate from any conduit through which coal and combustion supporting gas are introduced into the gasifier, a stream of finely divided heat protective and heat-resistant solid synthetic slag particles which are substantially noncorrosive to metallic surfaces, with said synthetic slag particles being introduced at a rate sufficient for forming and replacing erodedaway portions of base layers of solid synthetic slag on which coal-formed slag particles become accreted, so that the layers of slag provide heat protection between said metallic surfaces and the zone of combustion without causing the layers of slag to thicken to an extent at which their volume impedes the outflow of molten slag from the gasifier.

2. The process of claim 1 in which the gasifier contains a plurality of said burners and said stream of particles is injected near and substantially around the face of each burner.

3. The process of claim 2 in which the gaseous products of combustion are outflowed from an upper portion of the gasifier and molten slag is formed by a quenching of the outflowing combustion gas.

4. The process of claim 3 in which molten slag is formed in the upper portion of the gasifier by condensing gas-entrained particles of fly slag.

5. The process of claim 1 in which the injected particles are silica particles.

* * * * *